US006867572B1

(12) United States Patent
Lin

(10) Patent No.: US 6,867,572 B1
(45) Date of Patent: Mar. 15, 2005

(54) REGULATOR AND RELATED METHOD CAPABLE OF PERFORMING PRE-CHARGING

(75) Inventor: Peter Lin, Hsin-Tien (TW)

(73) Assignee: VIA Technologies Inc., Taipei Hsien (TW)

( * ) Notice: Subject to any disclaimer, the term of this patent is extended or adjusted under 35 U.S.C. 154(b) by 77 days.

(21) Appl. No.: 10/609,530

(22) Filed: Jul. 1, 2003

(30) Foreign Application Priority Data

Jan. 23, 2003 (TW) ..... 92101531 A

(51) Int. Cl.[7] ..... G05F 1/40
(52) U.S. Cl. ..... 323/273; 323/288
(58) Field of Search ..... 323/273, 276, 323/280, 282, 283, 288, 313

(56) References Cited

U.S. PATENT DOCUMENTS 6,204,654 B1 * 3/2001 Miranda et al. ..... 323/316
6,272,029 B1 * 8/2001 Hirose ..... 363/59
6,388,433 B2 * 5/2002 Marty ..... 323/284
6,583,607 B1 * 6/2003 Marty et al. ..... 323/273
6,759,836 B1 * 7/2004 Black, Jr. ..... 323/288

* cited by examiner

*Primary Examiner*—Adolf Berhane
(74) *Attorney, Agent, or Firm*—Winston Hsu

(57) ABSTRACT

A regulator and related method for providing a regulated voltage. The regulator includes a bipolar junction transistor (BJT) as a charging circuit, a capacitive circuit formed for regulating the regulated voltage by bypass and regulation capacitors, an operational amplifier (OP-AMP), a bandgap circuit, and a pre-charging circuit. The capacitive circuit receives current to establish the regulated voltage. According to the regulated voltage, the OP-AMP biases the base of the BJT to obtain the accurate regulated voltage to control a current conducted to the capacitive circuit by the BJT. When the regulator starts to work, the OP-AMP is disabled to prevent the BJT from providing current. Instead the pre-charging circuit first provides a pre-charging current to charge the capacitive circuit, then the OP-AMP is enabled to turn on the BJT to charge the capacitive circuit and establish the steady-state regulated voltage.

20 Claims, 5 Drawing Sheets

REGULATOR AND RELATED METHOD CAPABLE OF PERFORMING PRE-CHARGING

BACKGROUND OF INVENTION

1. Field of the Invention

The present invention relates to a regulator for chip biasing and related control methods, and more particularly, to a regulator capable of charging a regulator capacitor with a pre-charging circuit so as to prevent a current-capture transistor of the regulator from generating initial currents that are too high, and related control methods.

2. Description of the Prior Art

In modern information society, a variety of electronic information apparatuses, such as cell-phones, personal computers and network servers, are all fabricated based on a microprocessor control system. How to enable a microprocessor to function normally is therefore becoming one of the most important R&D topics of modern information industry.

In general, a microprocessor control system is realized by one or more than one chips installed on a circuit board, like a printed circuit board. In order to achieve high integration, low power consumption and fast operation speed, a core circuit, which is installed in the chip for data calculation and information manipulation, is always biased by a low voltage and generates electrical signals of low levels correspondingly. However, low-leveled signals do not have the capability to drive data in the core circuit to circuits outside of the chip and vice versa, so the chip usually further comprises an I/O circuit as an I/O buffer. Since both data and signals that the core circuit manipulates are of low levels, these data and signals cannot be transmitted to a region outside of the chip unless they have been pumped by the I/O circuit to become data and signals of high levels. On the contrary, data transmitted from the region outside of the chip to the chip are to be transformed by the I/O circuit to become data of low levels.

A regulator, capable of generating a regulated voltage of a low level by referring a direct voltage of a high level, is usually for biasing the core circuit with the regulated voltage to bias the I/O circuit with the direct voltage. According to the prior art, the regulator is realized by a Zener diode. One end of the Zener diode is reversed biased by the direct voltage and the other end of the Zener diode outputs the regulated voltage, which is equal to a voltage difference between the direct voltage and a voltage across the two ends of the Zener diode.

However, the regulated voltage that the prior art regulator generates is neither precise nor stable.

SUMMARY OF INVENTION

It is therefore a primary objective of the claimed invention to provide a regulator capable of generating a precise and stable regulated voltage to overcome drawbacks of the prior art.

In a prototype regulator of the present invention, an operational amplifier is used to detect a regulated voltage established by a power module and controls a BJT transistor in a pre-charging circuit to charge the power module and to establish and stabilize the regulated voltage. However, in the beginning of operation, the operational amplifier probably feeds back too great a current to drive the pre-charging circuit and therefore burns the BJT transistor.

Therefore, an amended regulator, capable of pre-charging a power module with a pre-charging circuit before a charging circuit charges the power module, first generates a voltage whose level is slightly lower than that of the regulated voltage. In the meantime, the operational amplifier and the charging module are still disabled. When the regulated voltage rises and is equal to a predetermined voltage, the regulator then enables the operational amplifier and the charging module, enabling the operational amplifier to feedback control the charging circuit to establish and to keep the regulated voltage. Since the regulated voltage has risen and is equal to the predetermined voltage after the operational amplifier functions, the operational amplifier can therefore keep the current actuated by the BJT transistor to have a level between a predetermined range, overcoming the problem of the prototype regulator and providing the chip with a correct and stable bias voltage.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
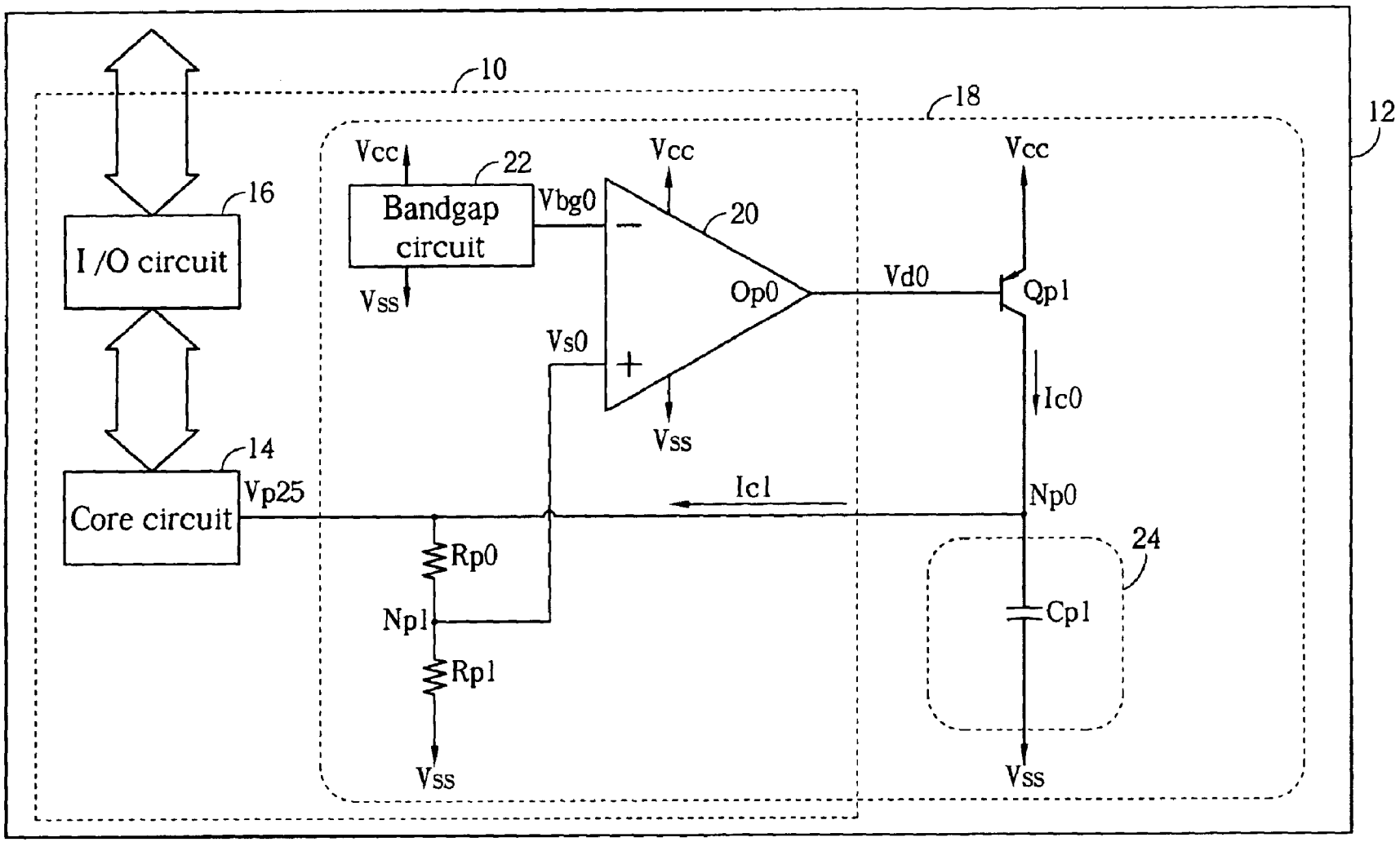
FIG. 1 is a function block diagram of a chip and a circuit board according to the present invention.

Please refer to FIG. 1, which is a function block diagram of a chip 10 and a circuit board 12, both of which are installed in a micro-controller system, according to the present invention. The circuit board 12, for example, is a motherboard and the chip 10 is a chip installed on the motherboard. The circuit board 12 can also be a printed circuit board with an add-on card installed and the chip 10 is for controlling the add-on card. The chip 10 comprises an I/O circuit 16 and a core circuit 14 for data calculation and information manipulation. The I/O circuit 16 buffers and transforms both data manipulated by the core circuit 14 and data ready to be transmitted to the circuit board 12 and raw data ready to be transmitted to the core circuit through the circuit board 12. As described previously, the core circuit 14 is biased by a low-leveled voltage and generates low-leveled data and signals of low levels, which are to be pumped by the I/O circuit 16 and then to be transmitted to the circuit board 12. On the contrary, the I/O circuit 16 reduces the voltage of both raw data and signals ready to be transmitted from the circuit board 12 to the core circuit.

Since the I/O circuit 16 is designed to exchange data with the circuit board 12 and vice versa, bias voltages to bias the I/O circuit 16 and the circuit board 12 are of equal levels. The circuit board 12 and the I/O circuit 16 of the chip 10 are biased by two distinct direct voltages Vcc and Vss (can be referred as ground) respectively. Since the core circuit 14 needs a low-leveled voltage as a bias voltage, the chip 10 has to combine with the circuit board 12 to form a regulator 18 to generate a regulated voltage Vp25 to bias the core circuit 14. Typically, the circuit board 12 provides the chip 10 with a direct voltage of 3.3 volts, while the bias voltage to bias the core circuit 14 is of 2.5 volts. For such a configuration, the regulator 18 generates the regulated voltage Vp25, capable of providing power for the core circuit 14 to operate, with the direct voltage Vcc of 3.3 volts.

In the regulator 18, a bipolar junction transistor Qp1, which is installed on the circuit board 12, functions as a charging circuit to provide currents. A capacitor Cp1 functions as a power module 24. In accordance with the transistor Qp1 and the power module 24, the chip 10 comprises an operational amplifier 20, a bandgap circuit 22 for generating a bandgap voltage Vbg0, and two voltage-dividing resistors Rp0 and Rp1. A bias voltage, whose level is between the direct voltages Vcc and Vss, biases the regulator 18. The operational amplifier 20 has two differential input ends, labeled by "+" and "−" and connected to node Np1 and to a bandgap voltage output end of the bandgap circuit 22 respectively. An output end Op0 of the operational amplifier 20 is electrically connected to a base of the transistor QP1 for biasing the base of the transistor Qp1 with a driving voltage as a driving signal. In operation, the chip 10 can connect the output end Op0 to the transistor Qp1 of the circuit board 12 with a pin. The direct voltage Vcc biases an emitter of the transistor Qp1. A collector of the transistor Qp1 is electrically connected to the power module 24 at node Np0. The power module 24 comprises a capacitor of high capacitance for voltage regulation and bypassing the interference of alternative fluctuation as well. The capacitor can be charged to a stable state and generates the regulated voltage Vp25 at node Np0. The regulated voltage Vp25 of the power module 24 at node Np0 can be transmitted back to the chip 10 through another corresponding pin. The regulated voltage Vp25 not only provides the core circuit 14 with the biased voltage, it also generates a divided voltage Vs0 at node Np1 through the use of the resistors Rp0 and Rp1. After comparing the bandgap voltage Vbg0 with the direct voltage Vs0, the operational amplifier 20 generates a driving voltage Vd0 to control the transistor Qp1.

Operations of the regulator 18 are described as follows: when the circuit board 12 enables the chip 10 to start to function, the circuit board 12 provides the regulator 18 with the direct voltage Vcc to enable the regulator 18 to function. In the meantime, the operational amplifier 20 also starts to compare a voltage Vs0 at node Np1 with the bandgap voltage Vbg0 generated by the bandgap circuit 22. Since node Np0 and the voltage Vs0 both are kept at low level before the regulator 18 functions, as the operational amplifier 20 starts to function, the operational amplifier 20 outputs the driving voltage Vd0 of a low level at the output end Op0 due to a comparison result that the voltage Vs0 is far smaller than the bandgap voltage Vbg0. In the mean time, a voltage across the emitter and base of the transistor Qp1 is almost equal to a voltage difference between the direct voltages Vcc and Vss, enabling the transistor Qp1 to generate a high-leveled current Ic0 as a charging current to charge the high-capacitanced capacitors Cp1 of the power module 24. As the charging process keeps functioning, the voltages at node Np0 as well as at node Np1 are increasing and the operational amplifier 20 keeps increasing the driving voltage Vd0 at the output end Op0. The degree to which the driving voltage Vd0 is increased corresponds to the degree to which a voltage across the emitter and base of the transistor Qp1 is decreased, enabling the transistor Qp1 to conduct lesser currents. The operational amplifier 20 is capable of controlling the driving voltage Vd0 by detecting the voltage Vs0 and stabling the voltage Vp25 at node Np0. After reaching to the stable state, the operational amplifier 20 keeps the voltage Vs0 to be equal to the bandgap voltage Vbg0. That is, the voltage Vp25 is equal to (1+Rp0/Rp1)Vbg0. Such the stable voltage Vp25 can function as the direct biased voltage for the core circuit 14. The current for the core circuit 14 to operate is therefore supplied by the transistor Qp1. Occasionally, when the voltage Vp25 is changed, the operational amplifier 20 accordingly controls the driving voltage Vd0 to be dynamically compensated. For example, if the core circuit 14 needs more current due to an increment of calculation, the capacitor Cp2 is capable of preventing the voltage Vp25 at node Np0 from dropping abruptly. The voltage Vp25 of a slightly reduced level enables the voltage Vs0 to drop accordingly and a voltage across the emitter and base of the transistor Qp1 to rise, thus increasing currents Ic0 flowing through the transistor Qp1 to meet the demand of increasing currents for the core circuit 14.

However, although the regulator 18 shown in FIG. 1 can generate the stable voltage Vp25 to bias the core circuit 14, the regulator 18 has a problem that the regulator 18 actuates too great currents to flow through the transistor Qp1 in the beginning, the too great currents probably burning the transistor Qp1. As described previously, when the regulator 18 starts to operate, voltage at node Np0 has a low level and the driving voltage Vd0 output by the operational amplifier 20 at the output end Op0 also has a low level. Therefore, a voltage across the emitter and base of the transistor Q1 is almost equal to a voltage difference, 3.3 volts for example, between the direct voltages Vcc and Vss. However, the level of the voltage across the emitter and base of the transistor Q1 for the transistor Q1 to actuate a significant current is generally equal to 0.7 to 0.8 volts. Theefore, the current actuated by the regulator in the beginning of operation is in fact greater than a current for the transistor Qp1 to operate normally dramatically. Such a high-leveled current probably burns the transistor Qp1 while the regulator 18 is in the beginning of operation.

Figure 2:
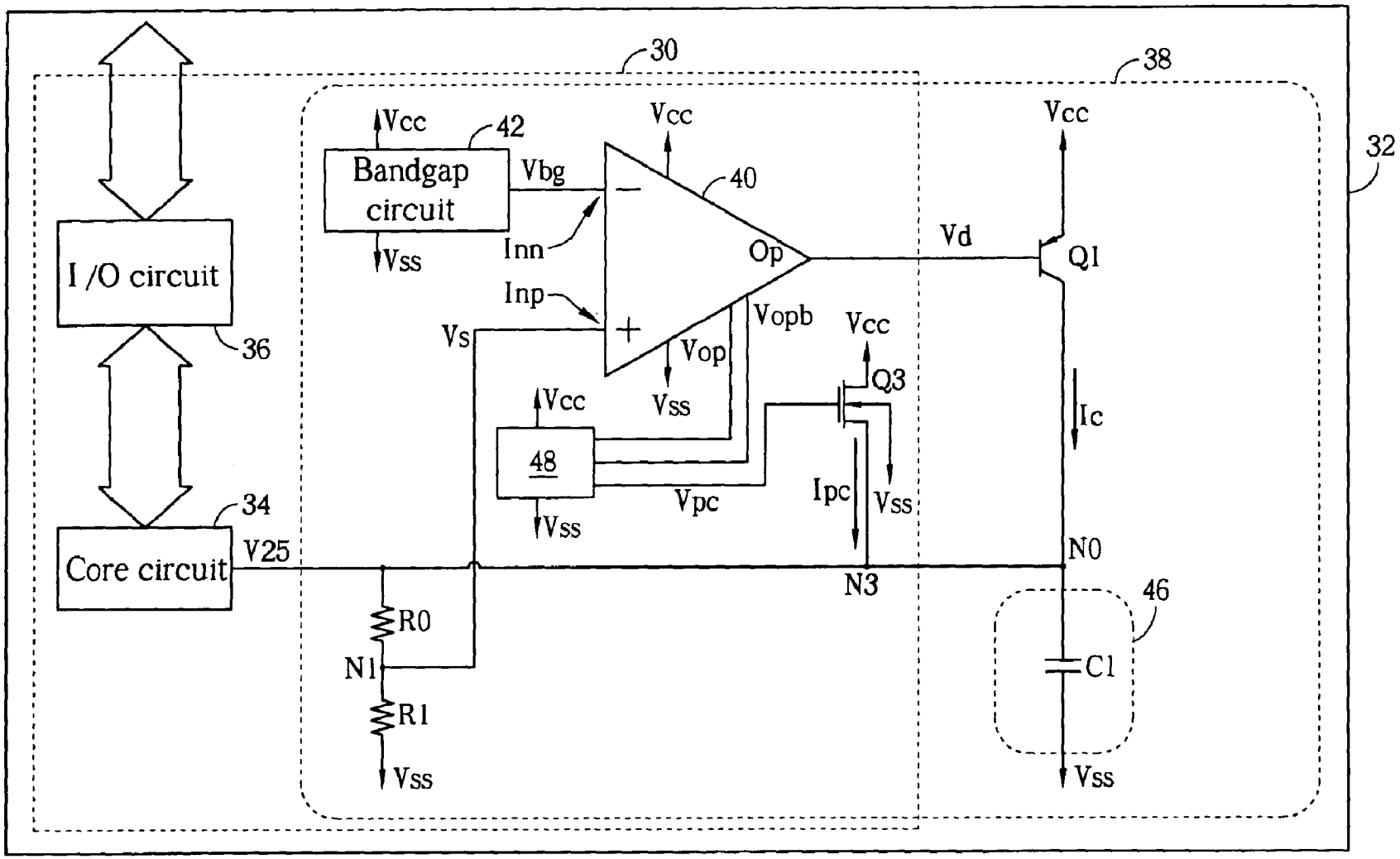
FIG. 2 is a function block diagram of a regulator fabricated between the chip and the circuit board shown in FIG. 1 according to the present invention.

Accordingly, the present invention also presents an amended regulator. Please refer to FIG. 2, which is a function block diagram of a regulator 38 fabricated between a chip 30 and a circuit board 32 according to the present invention. In accordance with allocation of modern microprocessor, the chip 30 also comprises a core circuit 34 and an I/O circuit 36, the core circuit 34 operating at the voltage V25 of a lower level, and the I/O circuit 36 as well as the circuit board 32 biased by the direct voltage Vcc of a higher level. The direct bias Vss can be ground of zero volts. In order to generate the regulated voltage V25 for the core circuit 34, a regulator 38 is fabricated between the chip 30 and the circuit board 32 for generating the regulated voltage V25 according to the direct bias Vcc provided by the circuit board 32. The regulator 38 is biased by a voltage between the direct bias Vcc and Vss. The regulator 38 comprises a bandgap voltage generator 42 fabricated in the chip 30 for generating a bandgap voltage Vbg, an operational amplifier 40, a control circuit 48, a MOS transistor Q3 functioning as a charge circuit, and two voltage-dividing resistors R0 and R1. In accordance with the above circuit, the circuit board 32 also comprises a BJT Q1 and a power module 46 for providing currents and appropriate reduced voltage. The operational amplifier 40 comprises a positive input end Inp electrically connected to node N1, a negative input end Inn for receiving the bandgap voltage Vbg, and an output end Op. In operation, the operational amplifier 40 generates a corresponding driving voltage Vd as a driving signal at the output end Op by referring by referring a voltage difference between the positive and negative input ends Inp and Inn.

The driving voltage Vd is for controlling a base of the transistor Q1. In practice, the chip 30 can comprises a pin to electrically connect the output end Op to the base of the transistor Q1, whose emitter is biased by the direct voltage Vcc and a collector is electrically connected to node N0. Based on the control of the driving voltage Vd, the transistor Q1 is capable of providing a charging current Ic to flow to node N0. The power module 46 comprises a capacitor C1 of high capacitance for voltage regulation and bypassing unnecessary interference, enabling a voltage at node N0 to be stable. With the power module 46 as a load, the regulator 38 is capable of generating the regulated voltage V25 at node N0. The regulated voltage V25 at node N0 can be transmitted back to the core circuit 34 for biasing the core circuit 34 by connecting node N0 through another pin in the chip 30 to a node N3 of the chip 30. The resistors R0 and R1 are capable of generating a dividing voltage Vs, equal to (R1/(R0+R1))V25, at node N1 and transmitting the dividing voltage Vs to the positive input end Inp of the operational amplifier 40.

In the present invention, the control circuit 48 generates voltage signals Vpc, Vop and Vopb as control signals. The transistor Q3, as a pre-charging circuit, comprises a drain biased by the direct voltage Vcc, a body biased by the direct voltage Vss, a gate controlled by the voltage Vpc, and a source electrically connected to node N3. With the above connection, the transistor Q3 is capable of generating a pre-charging current to flow to node N3 based on the control of the control circuit 48. The operational amplifier 40, controlled by the voltage Vop as well as Vopb, selectably either disables the operational amplifier 40 to stop functioning or enables the operational amplifier 40 to start to function. In the preferred embodiment of the present invention, when the operational amplifier 40 is disabled, the operational amplifier 40 continuously outputs a high-leveled voltage (that is the direct voltage Vcc) at the output end Op to turn off the transistor Q1. When the operational amplifier 40 is enabled, the operational amplifier 40 generates the corresponding driving voltage Vd at the output end Op by referring a voltage difference between the positive and negative input ends Inp and Inn.

In accordance with the above allocation, the regulator 38 functions as following descriptions. In the beginning, the circuit board 32 provides the chip 30 and the regulator 38 with the direct voltage Vcc. In the meantime, the control circuit 48 disables the operational amplifier 40 with the voltages Vop and Vopb. As described previously, the disabled operational amplifier 40 outputs the driving voltage of a high level at the output end OP and disables the transistor Q1 to actuate currents because of a voltage of substantial zero volts between the emitter and base of the transistor Q1. While the operational amplifier 40 is disabling, the control circuit 48 controls the transistor Q3 with the voltage Vpc of a high level to provide the pre-charging charge Ipc to flow through nodes N3 and N0 and charge the power module 46. In other words, at this moment the pre-charge current Ipc for charging the power module 46 is not generated by the transistor Q1, but by the transistor Q3 instead. As the transistor Q3 keeps charging the power module 46, the regulated voltage V25 at node N0 rises from a voltage of a low-level (equal to the level of the direct voltage Vss), and the control circuit 48 keeps estimating how high the regulated voltage V25 has risen until the control circuit 48 estimates that the regulated voltage V25 has risen to a voltage equal to a predetermined voltage. In the preferred embodiment of the present invention, the predetermined voltage is a voltage whose level is slightly lower than that of the regulated voltage V25. As soon as the control circuit 48 has estimated that the regulated voltage V25 has risen to the predetermined voltage, the control circuit 48 changes levels of the voltage signals Vop, Vopb and Vpc, enables the operational amplifier 40, and turns off the transistor Q3 not to provide the pre-charging current Ipc. After starting to function, the operational amplifier 40 generates the corresponding driving voltage Vd by referring a voltage difference between the voltage Vs and the bandgap voltage Vbg and controls the transistor Q1 to actuate the charging current Ic to charge the power module 46. Eventually, the operational amplifier 40 keeps the regulated voltage V25 to have a stable level equal to (1+R0/R1)Vbg.

From the above descriptions, when the regulator 38 begins to function and the regulated voltage V25 is equal to zero volts, the regulator 38 disables the feedback control between the operational amplifier 40 and the transistor Q1, preventing the operational amplifier 40 from excessively driving the transistor Q1 because of too high a voltage difference between the voltage Vs and the bandgap voltage Vbg. When disabling the operational amplifier 40, the regulator 38 provides the pre-charging current Ipc with the transistor Q3, served as a pre-charging circuit, to flow to the power module 46 and to charge the capacitors C1 and C2, raising the regulated voltage V25 at node N0. As soon as the regulated voltage V25 is raised to the predetermined voltage, the control circuit 48 controls the transistor Q3 with the signal Vpc not to actuate and to stop providing the pre-charging current Ipc. The control circuit 48, in the meantime, enables the operational amplifier 40 with the signals Vop and Vopb, enabling the feedback control between the operational amplifier 40 and the transistor Q1 and stabilizing the regulated voltage V25. That is, while the operational amplifier 40 is functioning, the regulated voltage V25 is not a low-leveled voltage any more and the voltage Vs is becoming closer and closer to the bandgap voltage Vgp, enabling the operational amplifier 40 to output the driving voltage Vd of a level higher than that of the low-leveled voltage. Therefore, as the driving voltage Vd actuates the transistor Q1, a problem of too low a voltage between the emitter and base can be approved and the transistor Q1 will not be exceedingly driven to actuate too great a current.

Figure 3:
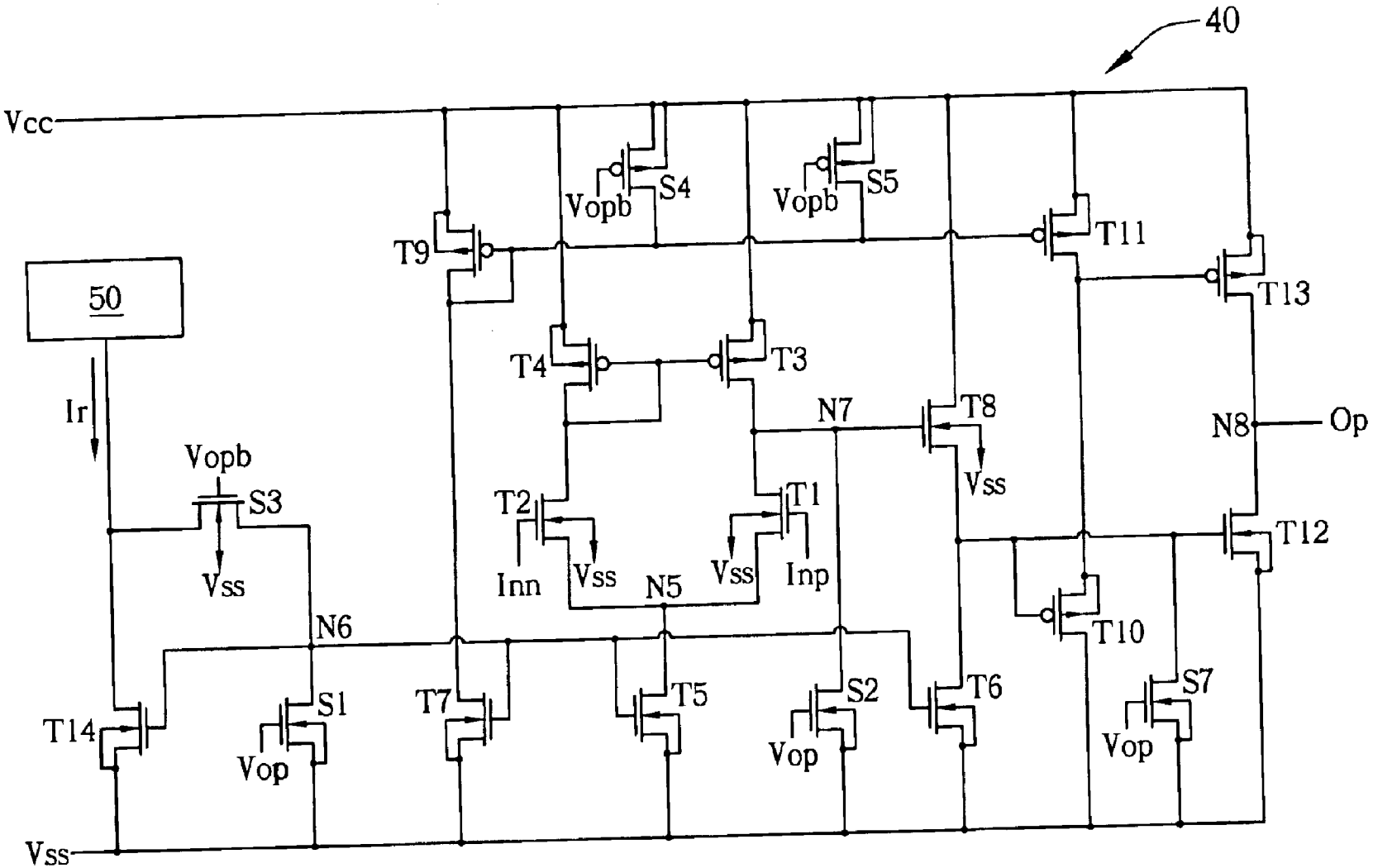
FIG. 3 is a circuit diagram of a practical embodiment of an operational amplifier according to the present invention.
Figure 4:
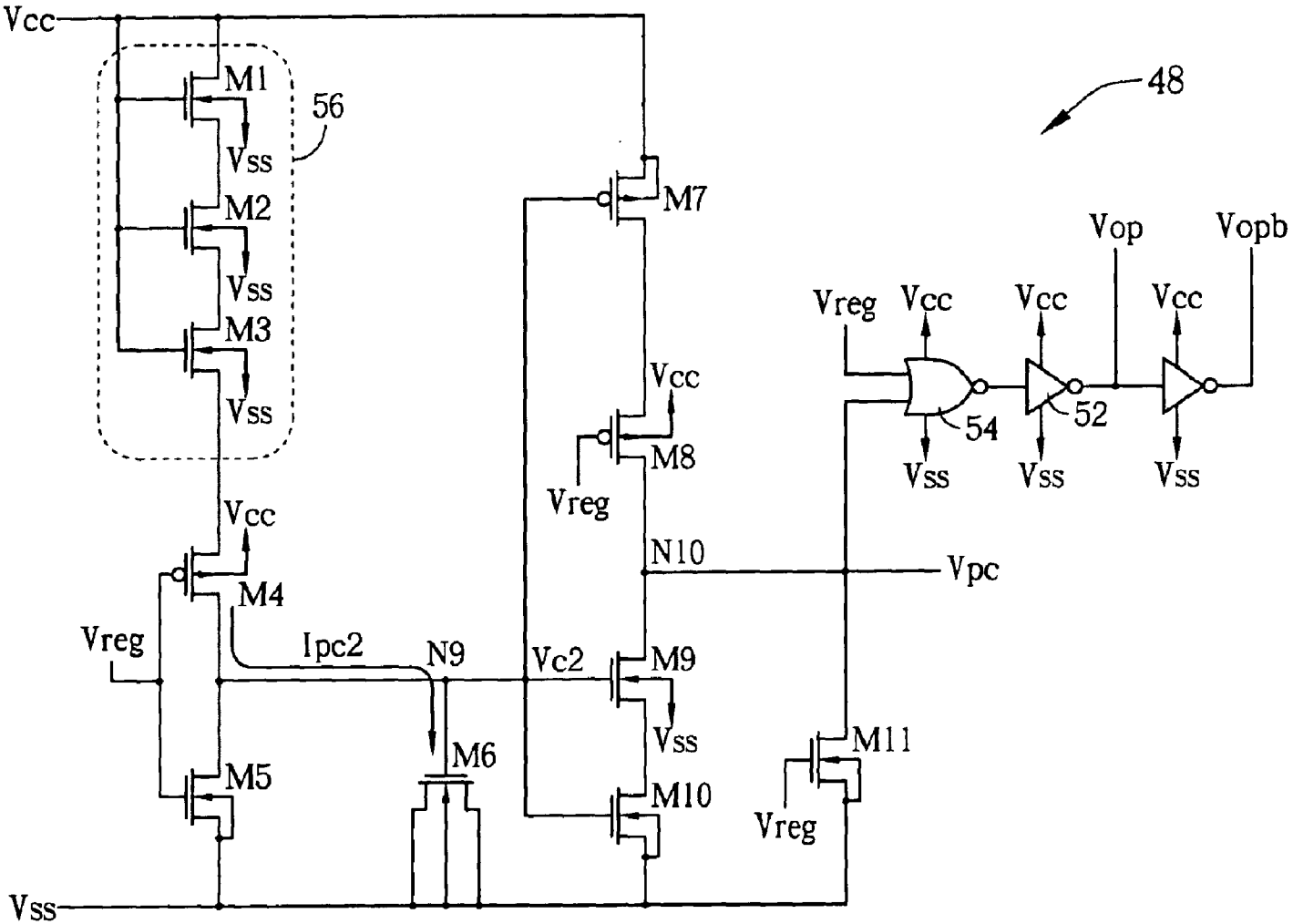
FIG. 4 is a circuit of a practical embodiment of a control circuit according to the present invention.

FIG. 3 is a circuit diagram of a practical embodiment of the operational amplifier 40 according to the present invention. FIG. 4 is a circuit of a practical embodiment of the control circuit 48 according to the present invention. As shown in FIG. 3, the operational amplifier 40 is biased by voltages ranging between the direct voltages Vcc and Vss and is composed of NMOS transistors T1, T2, T5 to T8, T12 and T14 and PMOS transistors T3, T4, T9 to T11 and T13. NMOS transistors S1 to S3 and S7 and PMOS transistors S4 and S5 are functioned as switch transistors for the need to enabling or disabling the operational amplifier 40. Each of the NMOS transistors comprises a body biased by the direct voltage Vss. Each of the PMOS transistors also comprises a body biased by the direct voltage Vcc. The transistors T1 and T2 form a differential pair. The transistors T1 and T2 comprise respective gates, serving as the positive and negative input ends of the operational amplifier 40. The transistor T5, connected to the differential pair at node N5 and serving as a current source for bias, comprises a gate electrically connected to gates of the transistors T6, T7 and T14 to form a current mirror. A support circuit 50, capable of generating a current Ir to serve as a reference current, adjusts a level of a bias voltage at node T5 through the use of the current mirror. The transistors T3 and T4 function as active loads of the differential pair. The transistors T3 and T4 comprise respective gates connected to gates of the transistors T9 and T11 and form another current mirror. In summary, the transistors T1 and T5 form a differential input stage of the operational amplifier 40. Signals amplified by the differential input stage are further amplified by a second stage, including the transistors T6 to T11, of the operational amplifier 40. The operational amplifier 40 has the transistors T12 and T13 as a class AB output stage and node N8 as the output end Op.

In contrast to the transistors T1 to T14, which form a basic structure of the operational amplifier 40, the switch transistors S1 to S7 control biases applied to the gates of the transistors T1 to T14 and enables or disables the operational amplifier 40. The transistors S1, S2 and S7 have gates controlled by the signal Vop generated by the control circuit 48, please further refer to FIG. 2, while the transistors S3 to S5 have gates controlled by the signal Vopb. Operations for the operational amplifier 40 to disable or enable by referring by referring the signals Vop and Vopb are described as follows: When disabling the operational amplifier 40, the control circuit sets the signals Vop and Vopb to have a high and low level respectively, conducting the switch transistors S1 to S7. Conducted transistors S1 and S3 reduce a voltage at node N6 to a voltage equal to the direct voltage Vss, turning off the transistors T5 to T7 and T14 and enabling the current Ir generated by the support circuit 50 to flow into the conducted transistor Q3 instead of the transistor Q14. Likewise, conducted transistors S2 and S7 pull voltages at the gates of the transistors TB and T12 down to a voltage equal to the direct voltage Vss and turn off the transistors T8 and T12 accordingly. The transistor T10 is actuated. Conducted transistors S4 and S5 pull voltages at the gates of the transistors T3, T4, T9 and T11 up to a voltage equal to the direct voltage Vcc and turn off these four transistors. The actuated transistor T10 combined with the turned off transistor T11 are capable of pulling a voltage at the gate of the transistor T13 down to a voltage of a low level, turning on the transistor T13, and pulling a voltage (the driving voltage shown in Fi.2) at the output end Op up to a voltage equal to the direct voltage Vcc. When the regulator 38 just starts operating, the operational amplifier 40 is disabled and the high-leveled driving voltage Vd at the output end makes a voltage difference between the emitter and the base of the transistor Q1 neglected and turns off the transistor Q1.

In contrast, when enabling the operational amplifier 40, the control circuit 48 pulls the voltage Vop up to a voltage of a high level and the voltage Vopb down to a voltage of a low level. The transistors S1 to S7 are then turned off from affecting biases applied to the gates of the transistors T1 to T14, the transistors T1 to T14 then capable of executing normal functions that the operational amplifier 40 has, generating the corresponding driving voltage Vd at the output end Op by referring by referring a voltage difference between the positive and negative input ends Inp and Inn.

As shown in FIG. 4, the control circuit 48 of the present invention comprises NMOS transistors M1 to M3, M5, M6, M9 to M11, PMOS transistors M4, M7 and M8, and an inverter 52 and a NOR gate 54, both of which are biased by voltages ranging between the direct voltage Vcc and Vss. Each of the PMOS transistors has a body biased by the direct voltage Vcc, while each of the NMOS has a body biased by the direct voltage Vss. The transistors M1 to M3 have respective gates all electrically connected to the direct voltage Vcc for forming an internal pre-charging circuit 56, which is electrically connected to a gate of the transistor M6 at node N9. The transistor M6 further comprises a drain and a source, both of which are biased by the direct voltage Vss and form a capacitor as a second power module. The internal pre-charging circuit 56 is capable of charging the capacitor formed by the transistor M6 and generating a voltage V2 at node N9. The transistors M7, M9 and M10 are connected to form a circuit of an inverter, receiving the voltage V2 as an input voltage with the gate and outputting the voltage Vpc for the control circuit 48 to control the transistor Q3 at node 10, please further refer to FIG. 5. Through the use of the NOR gate 54 and the inverter 52, the control circuit 48 is capable of generating another two control signals Vop and Vopb with the voltage Vpc to enable or disable the operational amplifier 40.

Figure 5:
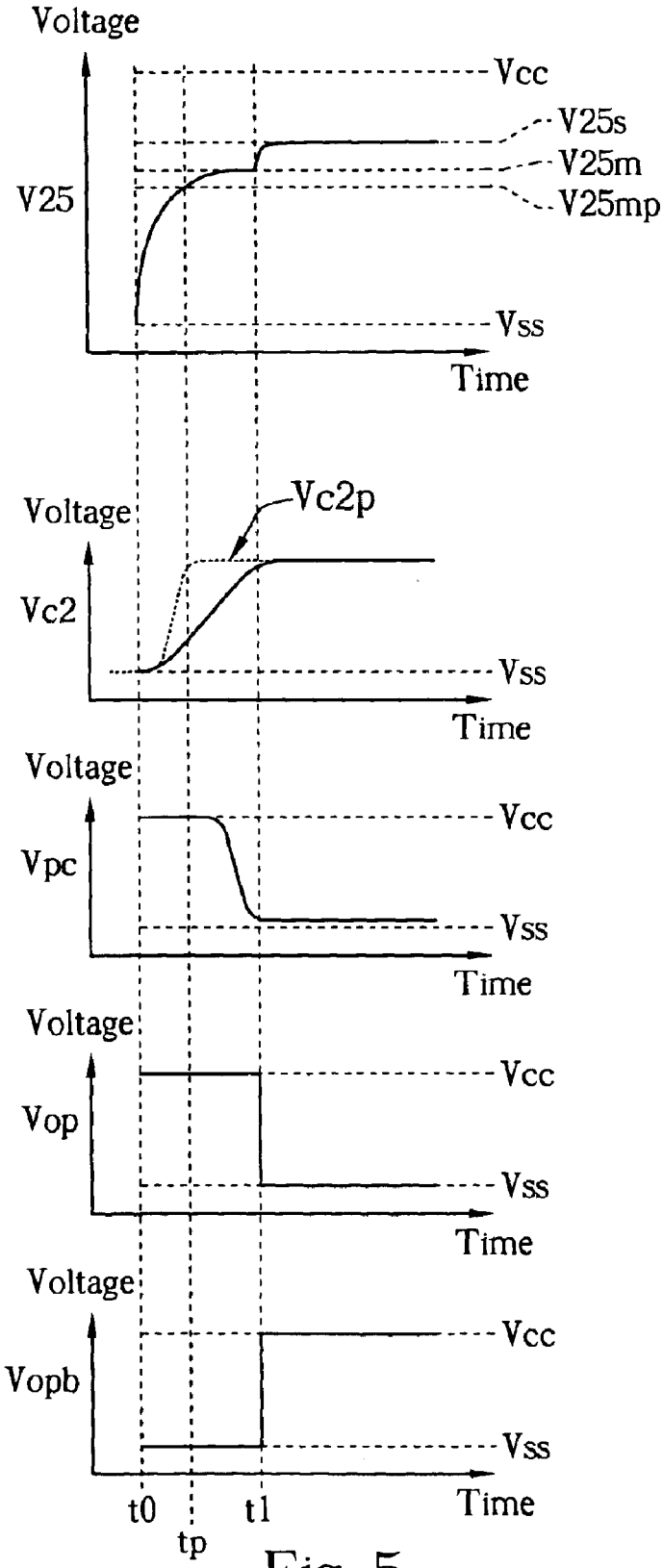
FIG. 5 is a timing diagram of voltages at corresponding nodes of a regulator in operation according to the present invention.

Please refer to FIG. 5, which is a timing diagram of voltages at corresponding nodes of the regulator 38 in operation according to the present invention, an abscissa representing time and an ordinate representing levels of the voltages. In FIG. 5, solid lines from top to bottom represent the regulated voltage V25, a voltage Vreg, the voltage V2 in the control circuit 48, as shown in FIG. 4, and the signals Vpc, Vop and Vopb for the control circuit 48 to control the transistor Q3 and the operational amplifier 40. In following paragraph FIG. 5 will be used to illustrate operations of the control circuit 48 and the regulator 38 as well. As shown in FIG. 5, it is assumed that the circuit board 32 enables the chip 30 to start to operate at time t0. As described previously, at this moment the circuit board 32 begins to provide the regulator 38 with the direct voltage Vcc. At time t0 the voltage Vreg of a low level enables the transistors M4 and MB (referring to FIG. 4) to be turned on and the transistors M5 and M11 to be turned off. In the meantime, the internal pre-charging circuit 56 begins to actuate a current Ipc2 as a second pre-charging current to flow to the gate of the transistor Q6 through node N9 due to the bias the direct voltage Vcc, like charging the capacitor formed by the transistor Q6 and raising the voltage V2 at node N9 for a voltage of a low level. However, a voltage at node N9 at time t0 is still a low-leveled voltage, which turns on the transistor M7 and turns off the transistors M9 and M10, pulling the voltage Vpc at node N10 as well as the voltage Vop up to voltages of high levels. The inverter 52 of the control circuit 48 pulls the signal Vopb down to a voltage of a low level. As described previously, the high-leveled voltage Vpx turns on the transistor Q3 and enables the transistor Q3 to actuate the pre-charging current Ipc to charge the power module 46 and to raise the voltage V25. In the meantime, the signal Vop has a high level and the signal Vopb has a low level, enabling the operational amplifier 40 to be disabled and to output the driving voltage Vd of a high level at the output end Op to turn off the transistor Q1 (referring to FIG. 2, FIG. 3, and corresponding descriptions).

As shown in FIG. 5, as the internal pre-charging circuit 56 charges the transistor M6 at time t0, the voltage V2 at node N9 starts to rise from a voltage of a low level and eventually reaches to a voltage great enough to turn off the transistor M7 and to turn on the transistors M9 and M10, thus reducing the high-leveled voltage Vpc at time t0 to the voltage Vpc of a low level at time t1, reducing the high-leveled voltage Vop to the voltage Vop of a low level, and raising the low-leveled voltage Vopb at time t1 to the voltage Vopb of a high level. Moreover, from the time t0 to t1, not only does the internal pre-charging circuit 56 of the control circuit 48 charge the capacitor formed by the transistor Q6, the transistor Q3, as a pre-charging circuit, of the regulator 38 also charges the capacitors C1 and C2 of the power module 46, raising the regulated voltage V25 at node N0 from the time to on. Up to time t1, the regulated voltage V25 has been raised to a voltage of a level equal to a voltage level V25*m*.

Since the voltages Vpc, Vop and Vopb at time t1 have changed, the transistor Q3 is then turned off and stops actuating the pre-charging current Ipc. The operational amplifier 40 begins to operate after time t1 and adjusts the driving voltage Vd to drive the transistor Q1 to charge the power module 46, raising the driving voltage Vd after time t1 until that the driving voltage Vd is stable. The stable driving voltage Vs is equal to (1+R0/R1)Vbg. For example, the stable driving voltage Vs is 2.5 volts. The stable driving voltage Vs can then used for the operations of the core circuit 34.

It is apparent from the previous descriptions that when the operational amplifier 40 and the transistor Q1 begin to operate, the regulated voltage V25 is generated by the transistor Q3 in the pre-charging circuit from time t0 to t1, from a voltage of a low level at time t0 to a voltage equal to the voltage V25*m* at time t1. The operational amplifier 40 drives the transistor Q1 at time t1 with the regulated voltage V25 instead of the driving voltage Vd of a low level and prevents the transistor Q1 from burning out due to too great a current. Additionally, it can be seen in FIG. 5 that the sooner the voltage Vc2 of the control circuit 48 is changed, the earlier the operational amplifier 40 as well as the transistor Q1 begin to operate. For example, if the voltage Vc2 changes in accordance with a dotted curve Vc2*p*, at time tp the voltage Vc2 rises to a voltage to enable the voltages Vpc and Vop to be reduced and the voltage Vopb to be increased. Therefore, as the regulated voltage V25 is raised to be equal the stable regulated voltage V25*mp*, the regulated voltage V25 is then made stable by the operational amplifier 40 and the transistor Q1. In other words, in order to control the transistors Q3 and Q1 capable of operating sequentially when the regulated voltage V25 is raised to be equal to a predetermined voltage, the internal pre-charging circuit 56 of the control circuit 48 can be controlled to adjust the speed to charge the transistor M6, the transistor Q3 charging the power module 46 to a voltage equal to the predetermined voltage when the voltage Vc2 is raised to a voltage whose level is high enough to trigger the voltages Vpc, Vop and Vopb to change. Moreover, the transistor M6 and currents actuated by the internal pre-charging circuit 56 can be adjusted to adjust the speed for the internal charging circuit 56 to charge the transistor M6. For example, if the current Ipc2 actuated by the pre-charging circuit 56 is equal to one-tenth of the pre-charging current Ipc flowing through the transistor Q3, and the equivalent capacitance of the transistor M6 is also equal to one-tenth of the equivalent capacitance of the power module 46, the voltage Vpc2 will rise as fast as the regulated voltage V25 when the transistor Q3 is in operation. Therefore, the rising speed for the voltage Vpc2 can be used to estimate the rising speed for the voltage V25 and the timing for the transistors Q3 and Q1 to operate sequentially.

In contrast to the prior art, the present invention can provide a regulator capable of providing a stable and concise regulated voltage in a feedback control manner. In the prototype regulator, since the operational amplifier controls the BJT transistor Qp1 to operate according to a low-leveled regulated voltage in the beginning and drives the transistor Qp1 exceedingly, the transistor Qp1 is easily burned-out, disabling the regulator to generate the regulated voltage and preventing the core circuit of the chip from getting the bias voltage and operating. In the present invention, the transistor Q3 functions as a pre-charging circuit and raises the regulated voltage to a voltage equal to a predetermined voltage prior to the operations of the operational amplifier and the BJT transistor Q1, preventing the transistor Q1 from burning out due to too great driving currents to drive the transistor Q1 after the operational amplifier starts to function, allowing the regulator to function normally thereafter, and ensuring that the core circuit can obtain the concise and stable bias voltage.

Following the detailed description of the present invention above, those skilled in the art will readily observe that numerous modifications and alterations of the device may be made while retaining the teachings of the invention. Accordingly, the above disclosure should be construed as limited only by the metes and bounds of the appended claims.

What is claimed is:

1. A pre-charging regulator for providing a regulated voltage, the regulator comprising:

a capacitive circuit for receiving charges provided by a charging current so as to establish the regulated voltage;

a pre-charging circuit electrically connected to the capacitive circuit for providing an input end of the capacitive circuit with a pre-charging current during a first initial period; and a charging circuit electrically connected to the capacitive circuit for generating the charging current after a second initial period.

2. The pre-charging regulator of claim 1, wherein the pre-charging current provided by the pre-charging circuit is capable of raising the regulated voltage, and as the regulated voltage is raised to a voltage equal to a predetermined voltage, the pre-charging stops providing the pre-charging current and the charging circuit starts to provide the input end the pre-charging current.

3. The pre-charging regulator of claim 1, wherein the charging circuit adjusts the charging current by referring a drive signal, the pre-charging regulator further comprising an operational amplifier for generating the drive signal according to the regulated voltage.

4. The pre-charging regulator of claim 3, wherein the operational amplifier generates the drive signal by referring a voltage difference between the regulated voltage and a reference voltage.

5. The pre-charging regulator of claim 3, wherein the drive signal generated by the operational amplifier reduces the charging circuit by the charging current when the regulated voltage is rising, and the pre-charging current provided by the pre-charging circuit starts to raise the regulated voltage before the charging circuit starts to provide the charging current.

6. The pre-charging regulator of claim 3 further comprising a controller for controlling the pre-charging circuit and the operational amplifier, as the pre-charging regulator starts to function, the controller controls the pre-charging circuit to start to provide the pre-charging current and controls the operational amplifier to disable generating the drive signal so as to prevent the charging circuit from providing the charging current.

7. The pre-charging regulator of claim 6, wherein the pre-charging current provided by the pre-charging circuit is capable of raising the regulated voltage, and the controller can estimate a range that the regulated voltage has been raised; the controller controls the pre-charging circuit to stop providing the pre-charging current and the operational amplifier start to generate the drive signal by referring the regulated voltage and enable the charging circuit to start to provide the charging current after controller controls the pre-charging circuit to stop to provide the pre-charging current and estimates that the regulated voltage has been raised to a voltage equal to the predetermined voltage.

8. The pre-charging regulator of claim 6, wherein the controller comprises:

an internal pre-charging circuit for providing a second pre-charging current; and a second capacitive circuit for receiving charges provided by the second pre-charging circuit so as to establish a second voltage by;

wherein as the controller controls the pre-charging circuit to start to provide the pre-charging current, the second pre-charging circuit starts to provide the second capacitive circuit the second pre-charging current, and the controller estimates the regulated voltage by referring the second voltage.

9. The pre-charging regulator of claim 8, wherein a first voltage increment gained by the second voltage in a unit period when the second capacitive circuit raises the second voltage by receiving the second pre-charging current is equal to a second voltage increment gained by the regulated voltage in the unit period when the capacitive circuit receives the pre-charging current.

10. The pre-charging regulator of claim 1, wherein the charging circuit comprises a bipolar junction transistor (BJT), the BJT comprising:

a base for receiving the drive signal; and a collector for outputting the charging current.

11. The pre-charging regulator of claim 1 being utilized to provide the regulated voltage to a chip installed on a circuit board, wherein the pre-charging circuit is installed in the chip, and the charging circuit and the capacitive circuit are installed on the circuit board.

12. The pre-charging circuit of claim 1, wherein the first initial period is substantially equal to the second initial period.

13. A method for controlling a regulator to provide a regulated voltage, the regulator comprising:

a capacitive circuit having an input end for receiving a current, the capacitive circuit being capable of storing charges provided by the current and correspondingly establishing the regulated voltage;

a charging circuit electrically connected to the input end for providing the input end with a corresponding charging current; and a pre-charging circuit electrically connected to the input end for providing the input end with a pre-charging current;

the method comprising:

enabling the pre-charging circuit to start to provide the pre-charging current before enabling the charging circuit start to provide the charging current.

14. The method of claim 13, wherein the pre-charging current provided by the pre-charging circuit is capable of raising the regulated voltage, the method further comprising:

as the regulated voltage has been raised to a voltage equal to a predetermined voltage, enabling the pre-charging circuit to stop to provide the pre-charging current and enabling the charging circuit to start to provide the input end with the charging current.

15. The method of claim 13, wherein the charging circuit adjusts the charging current by referring a drive signal, the regulator further comprising an operational amplifier for generating the drive signal according to the regulated voltage, wherein the operational amplifier generates the drive signal according to a voltage difference between the regulated voltage and a reference voltage.

16. The method of claim 15, wherein when the regulated voltage is rising, the drive signal generated by the operational amplifier reduces the charging circuit by the charging current, and the pre-charging current provided by the pre-charging circuit starts to raise the regulated voltage before the charging circuit starts to provide the charging current.

17. The method of claim 15 further comprising: as the regulator starts to function, enabling the pre-charging circuit to start to provide the pre-charging current and disabling the operational amplifier to generate the drive signal so as to prevent the charging circuit from providing the charging current.

18. The method of claim 17, wherein the pre-charging current provided by the pre-charging circuit is capable of raising the regulated voltage, the method further comprising:

estimating a voltage increment gained by the regulated voltage when executing enabling the pre-charging circuit to start to provide the pre-charging current, and when the voltage increment is equal to a predetermined voltage, enabling the pre-charging circuit to stop providing the pre-charging current, enabling the operational amplifier to start to generate the drive signal by referring the regulated voltage, and enabling the charging circuit to start to provide the charging current.

19. The method of claim 17, wherein the regulator further comprises:

an internal pre-charging circuit for providing a second pre-charging current; and a second capacitive circuit for receiving charges provided by the second pre-charging current so as to establish a second voltage;

the method further comprising:

enabling the second pre-charging circuit to start to provide the second energy module with the second pre-charging current as the pre-charging circuit starts to provide the pre-charging current; and estimating a level of the regulated voltage by referring a level of the second voltage.

20. The method of claim 19, wherein a first voltage increment that the second voltage has gained in a unit period when the second energy module receives the second pre-charging current and starts to raise the second voltage is equal to a second voltage increment that the regulated voltage has gained in the unit period when the energy module receives the pre-charging current.

* * * * *